United States Patent [19]

Vizmuller

[11] 4,365,221

[45] Dec. 21, 1982

[54] HELICAL RESONATOR FILTER WITH DIELECTRIC APERTURES

[75] Inventor: Peter Vizmuller, Thornhill, Canada

[73] Assignee: Motorola Canada Limited, Willowdale, Canada

[21] Appl. No.: 248,911

[22] Filed: Mar. 30, 1981

[51] Int. Cl.[3] ..... H01P 1/20; H01P 7/00

[52] U.S. Cl. ..... 333/202; 333/219

[58] Field of Search ..... 333/202, 219, 222–226, 333/245, 206–207, 227, 230, 24 C

[56] References Cited

U.S. PATENT DOCUMENTS

| | | | |
|---|---|---|---|
| 2,188,651 | 6/1940 | Cox | 336/179 |
| 2,890,422 | 6/1959 | Schlicke | 333/202 X |
| 3,538,463 | 11/1970 | Pakan | 333/226 |
| 3,691,487 | 6/1972 | Yoshimoto | 333/212 X |
| 3,713,051 | 1/1973 | Kell | 333/202 X |
| 3,939,443 | 2/1976 | Biro et al. | 333/24 C X |
| 3,973,226 | 8/1976 | Affolter et al. | 333/202 |
| 4,101,854 | 7/1978 | Gikow | 333/207 X |
| 4,179,673 | 12/1979 | Nishikawa et al. | 333/202 X |
| 4,210,884 | 7/1980 | Tabuchi et al. | 333/212 |

OTHER PUBLICATIONS

"The International Dictionary of Physics and Electronics," D. Van Nostrand, Princeton, N.J., 1961, Title Page and p. 175.

*Primary Examiner*—Marvin L. Nussbaum

*Attorney, Agent, or Firm*—Rolland R. Hackbart; James W. Gillman

[57] ABSTRACT

A helical resonator filter includes several helical coils, each grounded at one end and free at the other and enclosed within a cavity. The coils are coupled to each other electromagnetically through apertures in the conductive walls separating the resonator cavities from each other. A dielectric member is inserted into the apertures to increase coupling between adjacent coils to increase the bandwidth of the filter.

3 Claims, 3 Drawing Figures

HELICAL RESONATOR FILTER WITH DIELECTRIC APERTURES

FIELD OF INVENTION

This invention relates to a helical resonator filter and, more particularly, to an improved helical resonator filter with dielectric apertures.

BACKGROUND OF THE INVENTION

The usual form of a helical resonator filter consists of several helical coils, each wound in the form of a helix, a conductive shell or housing having cavities, each cavity separated by a separating wall from the adjacent cavity and each cavity having a helical coil. The separating wall is apertured to provide an electromagnetic coupling between adjacent helical coils. An inherent characteristic of a conventional helical resonator is that the bandwidth of the filter is determined by the size of the helical coil, the cavity and the coupling apertures. The other words, the maximum bandwidth that can be provided by the helical resonator filter is set by the geometry of the elements that constitute the resonator. In many applications it is desirable to widen the bandwidth without changing the physical size of the resonator or any components thereof.

SUMMARY OF THE INVENTION

It is an object of the invention to provide an improved helical resonator filter.

It is yet another object of the present invention to provide an increased bandwidth of a helical resonator filter without changing the physical size of the resonator or the components thereof.

The foregoing objects of the present invention are obtained in accordance with the present invention by inserting a dielectric member in the apertures separating the resonating cavities. It is found that the dielectric member increases the electromagnetic coupling between the adjacent resonators, that is, the resonating cavities. The foregoing and other objects and features of the present invention will be more clearly understood from a detailed description of an illustrative embodiment of the present invention in conjunction with the accompanying drawing.

DETAILED DESCRIPTION

Figure 1:
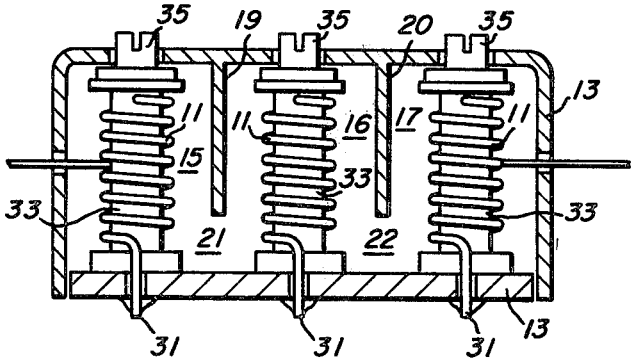
PRIOR ART Fig. 1
FIG. 1 shows a cut-away side view of a conventional helical resonator filter with portions of the housing broken away.

Referring to FIG. 1, according to the prior art a helical resonator filter includes two or more helical coils 11. The resonator filter also includes a conductive housing or shell 13 with a plurality of cavities 15, 16 and 17. The cavities may be in the form of a rectangle shape or cylindrical shape, and each of the cavities is separated by conductive separating walls 19 and 20 which separate adjacent coils. The separating walls include apertures 21 and 22 which provide electromagnetic coupling between the adjacent helical coils. One end 31 of each of the helical coils is fixedly and conductively attached to the conductive shell 13 and thus becomes grounded as the conductive shell itself is used as the grounding plane in the application. For fine-tuning purposes, a metallic tuning screw 35, can be axially positioned inside the helix near the ungrounded end.

The bandwidth of the helical resonator filter of the prior art is determined by the size of the cavities, the helical coil and the aperture size. The larger the aperture between the adjacent coils is, the higher the coupling therebetween becomes. Also, the maximum bandwidth of the resonator filter is limited by the size of the cavities, the coil and apertures. Accordingly, the maximum bandwidth that can be attained by a helical resonator filter is very much fixed by the physical size of the component elements.

Figure 2:
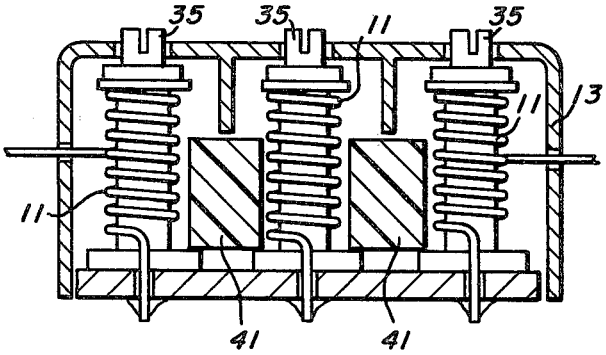
FIG. 2 shows an illustrative embodiment of a helical resonator with dielectric member inserted in the apertures between the resonating cavities.

In accordance with the present invention, dielectric material of a suitable composition such as teflon or alumina is placed in the apertures between the cavities, as illustrated in FIG. 2. The dielectric member 41 is in the form of a dielectric block dimensioned to fit in the apertures as illustrated. The dielectric 41 may or may not make physical contact with the helical resonators. The insertion of the dielectric block or element 41 increases the bandwidth without affecting the insertion loss.

One of the inherent characteristics of a helical resonator filter is the change of the percentage bandwidth with the center frequency. Thus, the useful frequency range of a filter is usually less than the range of resonant frequencies of the individual resonators or individual cavities with the coils. By using the dielectric apertures as described above with reference to FIG. 2, sufficient bandwidth has been obtained even near the lower frequency limit of the resonators, thereby, extending the useful frequency range of the filter. A filter was built embodying the principles of the present invention as specifically set forth below.

Figure 3:
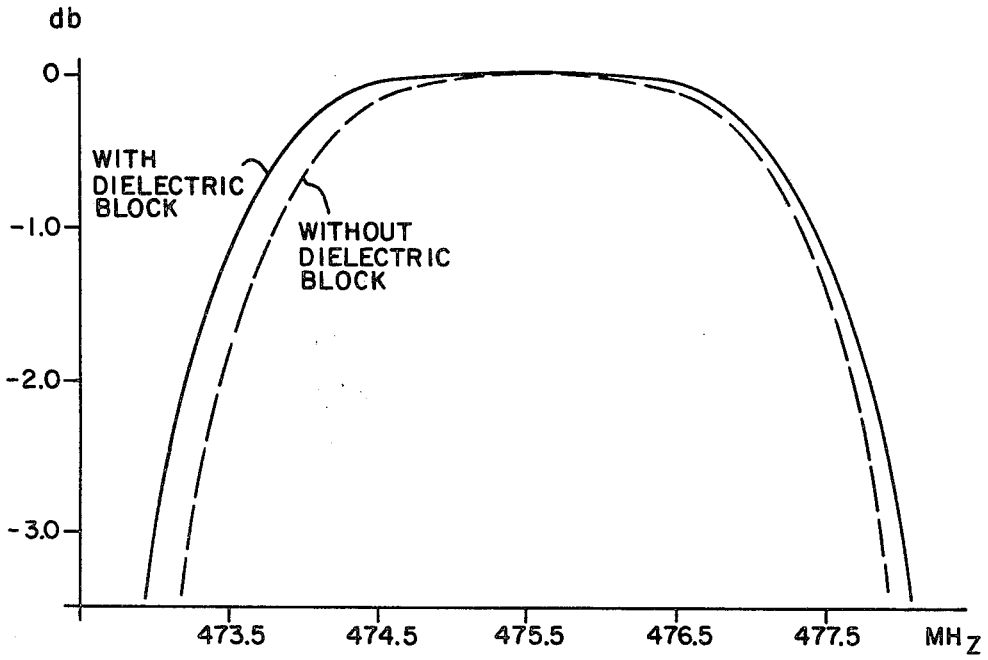
FIG. 3 shows frequency response characteristics of the filters with and without dielectric element.

Cavity Width = 10.5 mm
Cavity Height = 18.7 mm
Helix Outside Diameter = 7.3 mm
Number of Cavities = 3
Wire Gauge = 20. 7¾ turns of coil
Pitch of the Helix = 1.6 mm/turn
Size of the dielectric = 4.8 × 9.75 × 4.6 mm
Material of the dielectric = Polypropylene The filter built according to the above specification produced frequency response characteristics, as shown in a solid curve in FIG. 3. Comparison of this solid curve to a dotted line curve which is a response characteristics of a conventional filter graphically illustrates the improvement in the response as follows:

| | With Dielectric | Without Dielectric |
|---|---|---|
| Bandwidth at 0.5 db point | 6.25 Mhz | 5.15 Mhz |
| Bandwidth at 1.0 db point | 7.50 Mhz | 6.35 Mhz |
| Bandwidth at 3.0 db point | 9.95 Mhz | 8.80 Mhz |
| Insertion loss | 1.45 db | 1.55 db |
| Return loss | −24. db | −32. db |

Various modifications and changes may be made without departing from the spirit and scope of the present invention.

What is claimed is:

1. A helical resonator filter comprising:

a plurality of conductive helical coils;

a conductive shell having a plurality of cavities, each cavity including one of said helical coils and separated by conductive walls, the wall between adjacent cavities having an aperture for providing electromagnetic coupling between adjacent helical coils; and a dielectric member inserted in each of the apertures to increase the electromagnetic coupling between adjacent helical coils.

2. The helical resonator filter according to claim 1, wherein each dielectric member is comprised of a block of dielectric material that is substantially the same size as the aperture in which it is located.

3. The helical resonator filter according to claim 1, wherein each dielectric member is comprised of a block of dielectric material that is substantially the same size as the aperture in which it is located and that physically contacts the helical coils between which it is located.

* * * * *